United States Patent [19]

Vlemmings

[11] 3,961,870

[45] June 8, 1976

[54] GEAR PUMP OR MOTOR WITH RADIAL BALANCING

[75] Inventor: Jan Vlemmings, Hochdorf, Germany

[73] Assignee: Robert Bosch G.m.b.H., Stuttgart, Germany

[22] Filed: Oct. 15, 1974

[21] Appl. No.: 515,042

[30] Foreign Application Priority Data

Oct. 25, 1973 Germany ..... 2353445

[52] U.S. Cl. ..... 418/73; 418/131

[51] Int. Cl.[2] ..... F01C 21/02; F03C 3/00; F01C 19/08; F04C 15/00

[58] Field of Search ..... 418/71, 73, 131, 132

[56] References Cited

UNITED STATES PATENTS

| | | | |
|---|---|---|---|
| 2,870,719 | 1/1959 | Murray et al. | 418/132 |
| 3,034,446 | 5/1962 | Brundage | 418/73 |
| 3,539,282 | 11/1970 | Forschner | 418/132 |

FOREIGN PATENTS OR APPLICATIONS

| | | | |
|---|---|---|---|
| 1,006,722 | 4/1957 | Germany | 418/73 |
| 963,445 | 7/1964 | United Kingdom | 418/73 |

*Primary Examiner*—John J. Vrablik
*Attorney, Agent, or Firm*—Michael J. Striker

[57] ABSTRACT

A gear type hydraulic pump or motor wherein the stubs of the gears are surrounded by annular bearing members which are non-rotatably mounted in the housing. The forces which the stubs tend to transmit to the respective bearing members are counteracted by hydrostatic pressure fields produced by pressurized fluid which is entrapped in plenum chambers defined and completely surrounded by rectangular frame-like gaskets which are recessed into the surfaces surrounding the bores of the bearing members and are spaced apart from the nearest end faces of the respective gears. The gaskets may bear directly against the peripheral surfaces of the stubs or against the peripheral surfaces of cylindrical sleeves which are received in the bores of the bearing members and only the outer end portions of which are a tight fit in the respective bearing members.

12 Claims, 4 Drawing Figures

GEAR PUMP OR MOTOR WITH RADIAL BALANCING

BACKGROUND OF THE INVENTION

The present invention relates to hydraulic machines in general, and more particularly to improvements in gear type hydraulic machines which can be operated as pumps or motors.

It is known to mount the stubs of mating gears of a hydraulic pump or motor in annular bearing members which are non-rotatably installed in the housing of the machine. It is also known to establish in the bearing members hydrostatic pressure fields to counteract the forces which are stubs transmit radially of the respective bearing members.

In a presently known gear type hydraulic machine, the stubs of the mating gears are mounted in two eight-shaped bearing members each of which has two bores, one for a stub of the first gear and the other for a stub of the other gear. The surfaces surrounding the bores of the eight-shaped bearing members have recesses which are to be filled with pressurized fluid to thus establish hydrostatic pressure fields in the region where a stub tends to bear directly against the internal surface of the respective bearing member. such machines have met with little success because the hydrostatic pressure fields are incapable of compensating for all or the major part of forces which the stubs apply to the bearing members and also because the pressure fields cannot invariably prevent metal-to-metal contact between the stubs and the respective bearing members. The situation is aggravated when the axis of a stub does not coincide with the axis of the respective bore; this invariably causes substantial variations in the magnitude of forces acting on the bearing members as considered in the axial direction of the stubs. Such unequal distribution of pressures results in pronounced flattening of internal surfaces of the bearing members as well as in excessive wear upon those end faces of the bearing members which are adjacent to the respective end faces of the gears. This contributes to more pronounced leakage of fluid and reduces the efficiency of the machine.

SUMMARY OF THE INVENTION

An object of the invention is to provide a novel and improved gear type hydraulic pump or motor wherein the wear upon the bearing members for the stubs of mating gears is less pronounced than in heretofore known machines of this character.

Another object of the invention is to provide novel and improved means for producing hydrostatic pressure fields between the stubs of gears and the bearing members in the housing of a hydraulic gear type pump or motor.

A further object of the invention is to provide novel and improved bearing members for the stubs of gears in gear type pumps or motors.

An additional object of the invention is to provide a gear type hydraulic pump or motor with novel and improved means for reducing the stresses upon the bearing members which receive the stubs of the gears and to reduce the magnitude of and to balance the stresses which the rotating gears apply to the housing of the pump or motor through the medium of stubs and bearing members.

The invention is embodied in a hydraulic machine which may constitute a pump or a motor and comprises a housing having an inlet opening for admission of a hydraulic fluid and an outlet opening for evacuation of fluid whereby the pressure of fluid in one of the openings exceeds the pressure of fluid in the other opening, a pair of mating gears which are rotatable in the housing and have pairs of coaxial stubs extending from their respective end faces, annular bearing members non-rotatably mounted in the housing, there being one bearing member for each stub and each bearing member having a bore for the respective stub and an internal surface surrounding its bore, and means for producing hydrostatic pressure fields between the stubs and the respective bearing members to counteract forces which the stubs transmit radially of the respective bearing members when the machine is in operation. In accordance with a feature of the invention, the means for producing hydrostatic fields comprises sealing elements which are recessed into the internal surfaces of the bearing members and define fluid-filled plenum chambers.

In accordance with a presently preferred embodiment of the invention, each plenum chamber communicates with the one opening of the housing and the internal surface of each bearing member has an arcuate groove extending all the way to the nearest end face of the respective gear. The sealing elements are disposed in the grooves (they preferably extend into complementary recesses machined into those portions of the respective internal surfaces which surround the corresponding grooves) and each sealing element is preferably elastic or deformable and is spaced apart from the nearest end face of the respective gear. Each sealing element may resemble a polygonal frame which completely surrounds the respective plenum chamber.

The novel features which are considered as characteristic of the invention are set forth in particular in the appended claims. The improved hydraulic machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
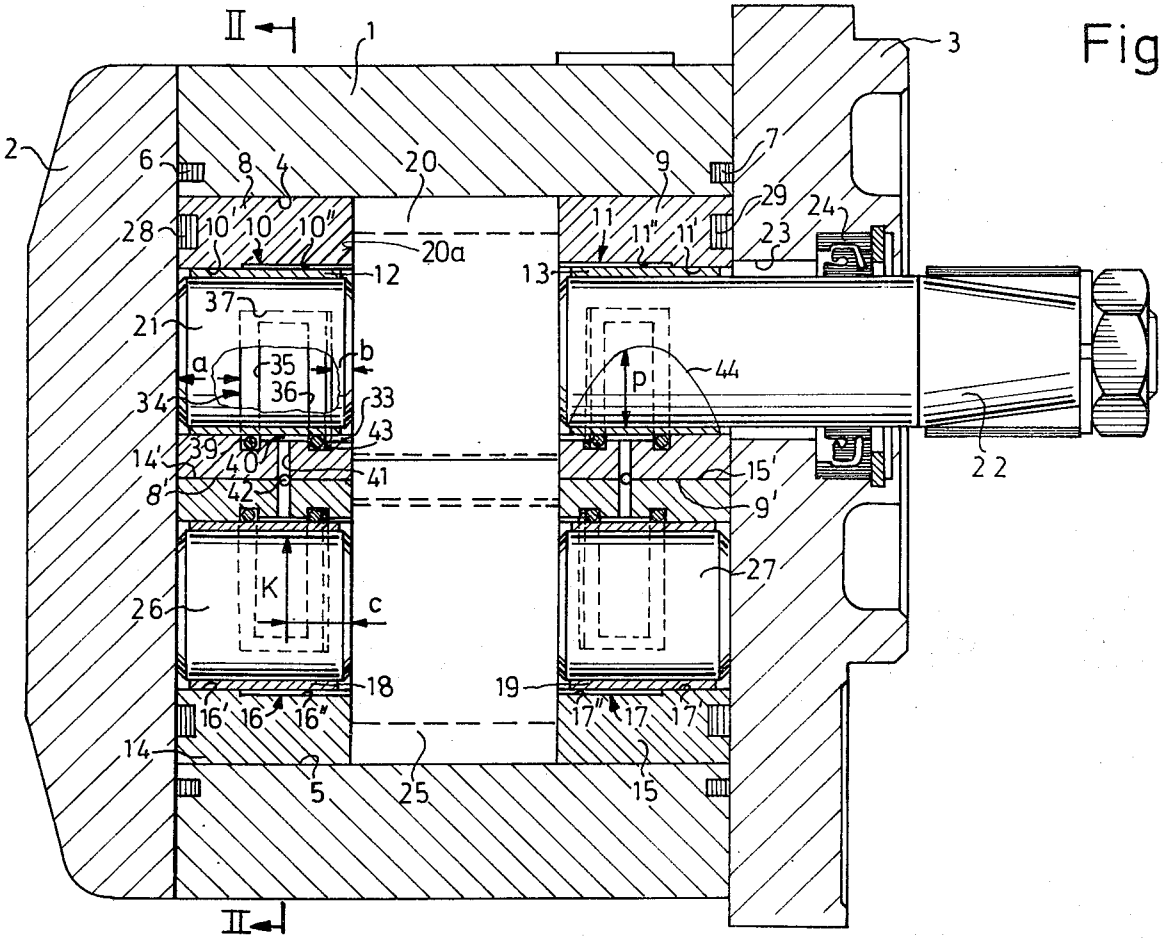
FIG. 1 is a central longitudinal sectional view of a hydraulic machine which embodies one form of the invention.
Figure 2:
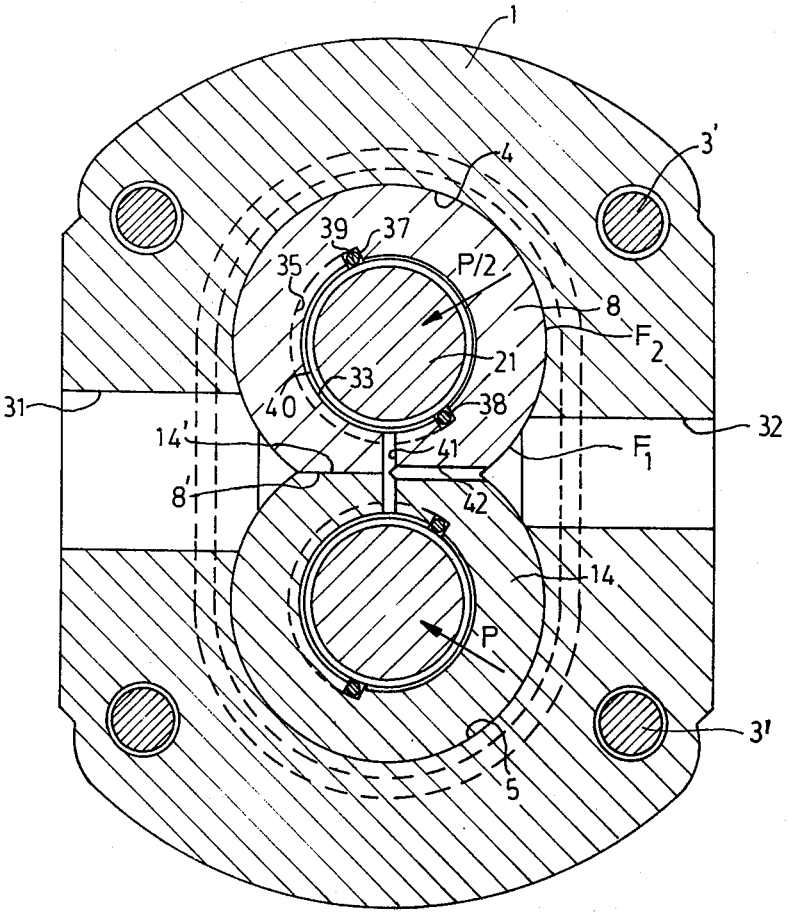
FIG. 2 is a sectional view as seen in the direction of arrows from the line II—II of FIG. 1.

The hydraulic machine of FIGS. 1 and 2 can be used as a pump or motor and comprises a housing or body including an open-ended annular main or central portion 1 and two end portions or covers 2 and 3 which overlie the respective ends of the main portion 1. The portions 1–3 of the housing are held together and urged against each other by elongated bolts 3′ (FIG. 2) or analogous connecting means.

The central portion 1 of the housing is formed with two parallel partially overlapping bores 4 and 5 which together form an eight-shaped compartment extending from the inner side of the end wall 2 to the inner side of the end wall 3. Gaskets 6 and 7 are respectively recessed into the left-hand and right-hand end faces of the main portion 1 (as viewed in FIG. 1) and are sealingly engaged by the inner sides of the respective end walls 2, 3 to prevent leakage of hydraulic fluid from the compartment.

The bore 4 of the central housing portion 1 receives two spaced-apart sleeve-like annular bearing members 8 and 9 which are respectively adjacent to the end walls 2, 3 and have axial bores 10 and 11. The bores 10 and 11 respectively receive cylindrical sleeves 12, 13 each having an axial length which is slightly less than or at most equal to the axial length of the respective bearing member. The bore 10 includes a smaller-diameter outer portion 10′ having a length *a* and being adjacent to the end wall 2, and a larger-diameter portion 10″ which is nearer to the bore 11. Analogously, the bore 11 has a smaller-diameter outer portion 11′ which is adjacent to the end wall 3 and has a length *a*, and a larger-diameter portion 11″ which is nearer to the bore 10. Each of the sleeves 12, 13 is a press-fit in the respective portion 10′, 11′ and is spacedly surrounded by the surface bounding the larger-diameter portion 10″, 11″.

The bore 5 of the central housing portion 1 receives two spaced-apart sleeve-like annular bearing members 14, 15 with axial bores 16, 17 having smaller-diameter outer portions 16′, 17′ of a length *a* and larger-diameter inner portions 16″, 17″. The bearing members 14, 15 are respectively adjacent to the end walls 2, 3 and receive cylindrical sleeves 18, 19 which are fitted into the respective bore portions 16′, 17′. The bearing members 8, 14 have abutting flats 8′, 14′ so that they cannot rotate relative to each other, and the bearing members 9, 15 have similar abutting flats 9′, 15′. The flats 8′, 9′, and 14′, 15′ are located in a plane which is disposed midway between the common axis of the bores 10, 11 and the common axis of the bores 16, 17.

A first gear 20 is located between the bearing members 8, 9 and has a first stub 21 which extends into the sleeve 12 and a second stub 22 which extends through and beyond the sleeve 13 to constitute an input shaft if the machine is used as a pump or as an output shaft if the machine is operated as a motor. The stub 22 extends with clearance through a bore 23 in the end wall 3 of the housing; this bore has a larger-diameter portion for a packing or shaft seal 24. The gear 20 meshes with a second gear 25 which is disposed between the bearing members 14, 15 and has coaxial stubs 26, 27 respectively extending into the cylindrical sleeves 18, 19. The gears 20, 25 may be spur gears, helical gears or herringbone gears. A gasket 28 is recessed into the left-hand end faces of the bearing members 8, 14, as viewed in FIG. 1, and is sealingly engaged by the inner side of the end wall 2. A similar gasket 29 is recessed into the right-hand end faces of the bearing members 9, 15 and is in sealing engagement with the inner side of the end wall 3. The gaskets 28, 29 surround pressure fields which serve to oppose forces acting upon the bearing members 8, 9, 14 and 15 in the axial direction of the gears 20 and 25. The provision of such pressure fields between the housing and the bearing members for the stubs of gears in a gear type pump or motor is known from the art.

The central portion 1 of the housing is formed with an opening or bore 31 whose axis is normal to the plane including the axes of the gears 20, 25 and which is located midway between such axes. The opening 31 is coaxial with a similar opening or bore 32 which is machined into the housing portion 1 at the opposite side of the common plane of the axes of gears 20 and 25. The pressure of hydraulic fluid in the opening 31 is less than the pressure of fluid in the opening 32, i.e., the opening 31 constitutes an inlet of the machine when the latter is operated as a pump and an outlet if the machine is operated as a motor. Analogously, the opening 32 admits pressurized fluid when the machine is operated as a motor and discharges pressurized fluid when the machine is operated as a pump.

In accordance with a feature of the invention, each of the bearing members 8, 9, 14 and 15 is configurated in a novel and improved way so as to successfully withstand and counteract the forces which are applied thereto by the respective stubs of the gears 20, 25 through the medium of the respective sleeves 12, 13, 18 and 19. Since the configuration of all four bearing members is identical, the following portion of the description will discuss in detail only the configuration of the bearing member 8.

That portion of the cylindrical internal surface of the bearing member 8 which surrounds the larger-diameter portion 10″ of the bore 10 therein is formed with a groove 33 which extends along an arc of approximately 180 degrees, as considered in the circumferential direction of the sleeve 12. The central portion of the groove 33 is in line with the direction of action of a force P/2 which is the resultant of forces transmitted to the sleeve 12 by the corresponding stub 21 of the gear 20. The force which the stub 21 applies to the sleeve 12 while a pressurized hydraulic fluid leaves or enters the housing via opening 32 is felt along the full length of the groove 33, and this groove extends all the way to the inner end face of the bearing member 8, i.e., to the adjacent end face 20*a* of the gear 20.

The surface which surrounds the groove 33 in the surface portion surrounding the larger-diameter bore portion 10″ is formed with a recess or depression 34 having, in developed view, a substantially rectangular outline and including two spaced-apart arcuate first portions 35, 36 which extend in the circumferential direction of the sleeve 12 and two second portions 37, 38 which are parallel to the axis of the sleeve 12 and connect the respective ends of the first portions 35, 36. The arcuate portion 35 extends all the way to the internal shoulder between the portions 10′, 10″ of the bore 10 in the bearing member 8, i.e., the distance between the left-hand end face of the bearing member 8 and the portion 35 (as viewed in FIG. 1) equals *a*. The distance between the arcuate portion 36 of the recess 34 and the inner end face of the bearing member 8 (i.e., the distance between the portion 36 and gear 20) is shown at *b*. It will be readily appreciated that the configuration of the recess 34 can be changed in a number of ways without departing from the spirit of the invention. All that counts is that the recess 34 can receive a substantially frame-like sealing element or gasket 39 which surrounds a plenum chamber 40. The pressure of hydraulic fluid in this chamber opposes the force P/2 which is being applied by the stub 21. In the embodiment of FIGS. 1 and 2, the configuration of the sealing element 39 is substantially complementary to that of the recess 34 except that the right-hand portion of the sealing element 39 is narrower than the portion 36 of the recess 34 in order to allow for introduction of an arcuate insert or washer 43 which prevents the sealing element 39 from bearing directly against the adjacent end face 20*a* of the gear 20. The thickness of the sealing element 39 exceeds the depth of the recess 34 so that the sealing element 39 can engage the peripheral surface of the sleeve 12, i.e., the sleeve 12 seals that side of the plenum chamber 40 which faces the stub 21. The length of the recess 34 and sealing element 39, as considered in the circumferential direction of the sleeve 12, equals the length of the groove 33.

The plenum chamber 40 communicates with a channel or port 41 which is machined into the bearing member 8 and extends to the flat 8'. The flats 8' and 14' are formed with grooves which together form a channel 42 (see particularly FIG. 2) serving to connect the channel or port 41 with the opening 32, i.e., with the high-pressure side of the machine. The insert or washer 43 is preferably affixed to the bearing member 8 and has a thickness which is somewhat less than the distance from the bottom of the portion 36 of recess 34 to the peripheral surface of the sleeve 12, as considered in the radial direction of the stub 21, i.e., the concave internal surface of the washer 43 normally does not contact the periphery of the sleeve 12.

The curve 44 in the right-hand portion of FIG. 1 illustrates the distribution of fluid pressure p upon the sleeve 12, 13, 18 or 19, as considered in the axial direction of the respective bearing member. It will be noted that the curve 44 is or closely resembles a parabola.

The configuration of the bearing members 9, 14 and 15 is identical to that of the bearing member 8, i.e., each of the bearing members 9, 14, 15 is also formed with an internal groove and with a recess in the surface bounding the groove, and each of the bearing members 9, 14, 15 contains a sealing element 39 and a washer 43. The plenum chambers in the members 9, 14 and 15 also communicate with the opening 32 of the central housing portion 1.

The basic mode of operation of the machine, either as a pump or motor, is known and need not be described here. When the gears 20, 25 rotate to convey fluid from the opening 31 toward the opening 32, or vice versa, each of the gears is subjected to the action of a force P which is generated by fluid pressure acting against a certain portion of the circumference of the respective gear. That portion of the circumference of gear 20 which is subjected to the action of fluid pressure in the high-pressure opening 32 is indicated at $F_1$. Another portion of the circumference of gear 20 which is subjected to the action of fluid pressure is shown at $F_2$; it is provided on that portion of the gear 20 which is adjacent to the surface bounding the bore 4 in the central hosing portion 1 and is adjacent to the portion $F_1$. The pressure of fluid decreases in a direction from the opening 32 along the internal surface bounding the bore 4, as considered in a counterclockwise direction (FIG. 2), and matches the pressure in the low-pressure opening 31 in the region to the left of the reference character 40 in FIG. 2. The magnitude of the force P depends on the pressure of fluid in the opening 32 as well as on the configuration of the gap between the teeth of the gear 20 and the surface surrounding the bore 4. The direction of the force P also depends on the configuration of the just mentioned gap. In FIG. 2, the direction of such force is indicated by the arrow below the reference character P/2. A force P acts upon each of the gears 20, 25 and, therefore, each of the four bearing members 8, 9, 14, 15 must take up a force which equals P/2.

The pressure of fluid in each plenum chamber 40 equals the fluid pressure in the opening 32, and the area of each of these chambers is selected with a view to neutralize the force which the stub 21, 22, 26 or 27 applies against the respective sleeve 12, 13, 18 or 19. Thus, and referring again to the bearing member 8, sleeve 12 and stub 21, the area which is surrounded by the sealing element 39 must be large enough to neutralize a force P/2. The direction of the force which is produced by fluid in the chamber 40 within the sealing element 39 is counter to the direction of action of the force P/2; the two forces must be of equal magnitude; and these forces must be in line with each other. The force which the fluid in plenum chamber 40 applies against the internal surface of the sleeve 12 is indicated at K, and the distance between the arrow indicating this force and the left-hand end face 20*a* of the gear 20 (as viewed in FIG. 1) is c. Eventual minor differences between the force K and the force P/2 are compensated for and taken up by that portion of the sleeve 12 which extends into the smaller-diameter portion 10' of the bore 10 in the bearing member 8, i.e., by a portion of the sleeve 12 having an axial length which equals *a*. The area and the position of the chamber 40 (as considered in the circumferential direction of the sleeve 12) can be readily calculated on the basis of data pertaining to the required fluid pressure in the opening 32, rotational speed of the stub 22, and desired throughput of the machine.

Since the sleeve 12 is received without clearance only in the smaller-diameter portion 10' of the bore 10 (as shown in FIG. 1, the axial length *a* of the portion 10' may be substantially less than the axial length of the entire bore 10), the groove 33 provides for the sleeve 12 sufficient freedom of movement radially of the stub 21 so that it can readily compensate for minor eccentricity or inclination of the axis of stub 21 with respect to the axis of the bore 10 in the bearing member 8; such minor inaccuracies are compensated for by elastic deformation of the sleeve 12 in the region of the groove 33. This allows for an optimum distribution of hydrodynamic pressures which develop in the bore 10 when the machine is in operation (see the aforementioned paraboloidal curve 44 which represents the distribution of fluid pressure as considered in the axial direction of a sleeve). Such distribution of fluid pressure insures a minimum of wear. Moreover, the pressure of fluid in the chamber 40 (such fluid exerts pressure against the sleeve 12 as well as against the bearing member 8) insures a highly desirable uniform distribution of stresses upon the member 8 which, in turn, insures that the deformation of the bearing member 8 in the region of its end faces is within permissible limits to thus guarantee better lubrication at the respective axial end of the gear 20. Finally, uniform distribution of stresses upon the bearing member 8 (and hence also upon the other three bearing members 9, 14 and 15) results in a reduction of stresses upon the housing 1–3.

If desired, the bearing members 8 and 9 may be respectively integral with the bearing members 14, 15. This reduces the need for the flats 8', 9', 14', 15' and for the number of discrete parts in the housing of the improved machine.

Figure 3:
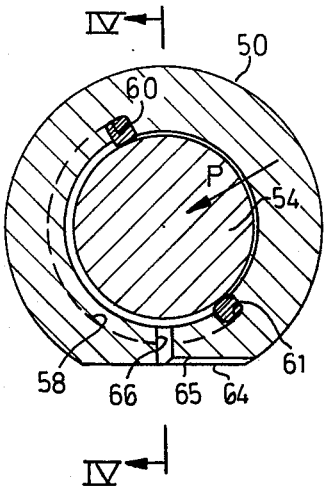
FIG. 3 is a transverse sectional view of a portion of a modified hydraulic machine, substantially as seen in the direction of arrows from the line III—III of FIG. 4.
Figure 4:
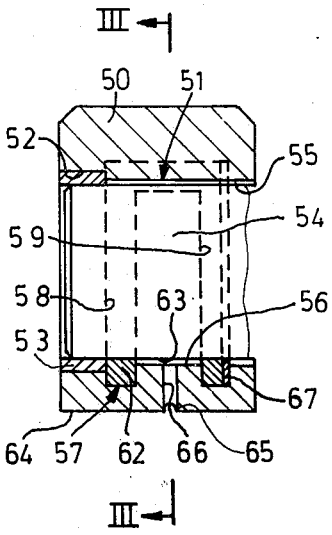
FIG. 4 is a sectional view as seen in the direction of arrows from the line IV—IV of FIG. 3.

FIGS. 3 and 4 show a modified sleeve-like annular bearing member 50 which can be utilized in the gear type pump or motor of the present invention. The bore 51 in the bearing member 50 has a larger-diameter portion 52 which is adjacent to the respective end wall (not shown) of the housing and receives a sleeve 53. The sleeve 53 is much shorter than the sleeve 12, 13, 18 or 19 of FIGS. 1–2, i.e., it does not extend from the bearing member 50 and it also does not extend into the smaller-diameter portion 55 of the bore 51. The stub of a gear is shown at 54; this stub extends into the sleeve 53 whose inner diameter is smaller than the diameter of the bore portion 55 so that the stub 54 normally does not contact the surface surrounding 55. The difference between the diameter of the stub 54 and the diameter of the bore portion 55 can be very small.

The surface surrounding the portion 55 of the bore 51 in the bearing member 50 is formed with a groove 56 which is of arcuate shape and whose central portion is in line with the direction of action of the force P acting upon the gear including the stub 54. The length of the groove 56, as considered in the circumferential direction of the stub 54, may be approximately 180 degrees. The surface bounding the groove 56 is formed with a recess 57 which is similar to the recess 34, i.e., it comprises two arcuate first portions 58, 59 which extend in the circumferential direction of the stub 54 and two second portions 60, 61 which are parallel to the axis of the stub 54 and establish communication between the respective ends of the portions 58, 59. The portion 58 extends all the way to the shoulder between the portions 52, 55 of the bore 51, i.e., to the right-hand end face of the sleeve 53, as viewed in FIG. 4.

The recess 57 receives a substantially rectangular frame-like gasket or sealing element 62 which is immediately adjacent to the sleeve 53 but does not completely fill the portion 59 of the recess 57 so as to provide room for introduction of an arcuate insert or washer 67 which prevents the sealing element 62 from expanding all the way to the nearest end face of the gear including the stub 54. The element 62 sealingly engages the peripheral surface of the stub 54 in the bore portion 55 and defines with the stub a plenum chamber 63 in communication with the high-pressure opening (inlet or outlet) of the machine by way of a channel or port 66 in the bearing member 50 and a channel having a first half 65 machined into the flat 64 of the bearing member 50 and a second half machined into the flat of the bearing member (not shown) which is in register with the bearing member 50 of FIGS. 3–4 when the latter is mounted in the housing of a hydraulic gear type pump or motor. The length of the washer 67, as considered in the circumferential direction of the stub 54, preferably equals the length of the portion 59 of the recess 57 and hence the length of the groove 56 and sealing element 62. The concave inner surface of the washer 57 is preferably out of contact with the peripheral surface of the stub 54.

The area of the plenum chamber 63 and its position (as considered in the circumferential direction of the stub 54) is selected in such a way that the fluid pressure in chamber 63 which acts against the peripheral surface of the stub 54 balances the force P/2, i.e., one-half of the force P which the gear including the stub 54 applies against the bearing member 50 and the associated other bearing member for the second stub of the gear. Hydrodynamic pressure fields which develop in the bore of the sleeve 52 when the machine is in use compensate for eventual minor differences between the force P/2 and the force which is produced by fluid pressure in the chamber 63. The radial clearance between the stub 54 and the surface surrounding the portion 55 of the bore 51, the radial clearance between the concave internal surface of the washer 67 and the peripheral surface of the stub 54, the elasticity of the sealing element 62 (whose material may but need not be identical with the elastic material of the sealing element 39), and the minimal axial length of the sleeve 53 insure that the stub 54 has sufficient freedom of movement to compensate for eventual misalignment of its axis with respect to the axis of the bore 51. The washer 67 cooperates with the nearest end face of the sleeve 53 to prevent shearing of the sealing element 62 when the stub 54 rotates. Since the fluid pressure in the chamber 63 balances the force (P/2) which the gear applies in the radial direction of its stub 54, and since the stub 54 has the aforediscussed freedom of limited radial movement in the region of the bore portion 55, the sleeve 50 is subjected to uniformly distributed stresses which contributes to more uniform distribution of stresses which act upon the housing of the machine. This is important because the total absence of or only a minor deformation of the housing reduces the quantity of leak fluid and contributes to higher efficiency of the machine and longer useful life of its parts.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. In a hydraulic machine, a combination comprising a housing having an inlet opening for admission of hydraulic fluid and an outlet opening for evacuation of fluid, the pressure of fluid in one of said openings being higher than the pressure of fluid in the other of said openings; a pair of mating gears rotatable in said housing and having two end faces and coaxial stubs extending beyond said end faces; bearing members mounted in said housing, one for each of said stubs and each having a bore for the respective stub, each of said bores having a smaller diameter portion remote from the respective gear and a larger diameter portion nearer to the respective gear and joined at a shoulder to the smaller diameter portion, said bearing members having internal surfaces bounding said bores thereof and said stubs transmitting forces radially of said bearing members when said machine is in operation, each of said internal surfaces having an arcuate groove extending from said shoulder to the nearest end face of the respective gear and each of said internal surfaces having a portion bounding the respective groove and said bearing members having recesses in said portion of said internal surfaces; cylindrical sleeves surrounding said stubs, each of said sleeves extending with minimum clearance into the smaller diameter portion and being radially spaced from the larger diameter portion of the respective bore; and means for producing hydrostatic pressure fields between said stubs and the respective bearing members to counteract said forces, including sealing elements disposed in said grooves, extending into the respective recesses and engaging the outer surface of the respective sleeves and being spaced apart from the nearest end face of the respective gear, said sealing elements defining fluid-filled plenum chambers.

2. A combination as defined in claim 1, wherein the sleeves are elastically deformable.

3. A combination as defined in claim 1, wherein each of said sealing elements completely surrounds the respective plenum chamber.

4. A combination as defined in claim 1, wherein each of said sealing elements has two spaced apart first portions extending in the circumferential direction of the respective stub and two spaced-apart second portions extending in parallelism with the axis of the respective stub, said first and second portions of said sealing elements completely surrounding the respective plenum chambers.

5. A combination as defined in claim 1, wherein each of said sleeves has a cylindrical peripheral surface in engagement with the respective sealing element so that the fluid in said plenum chambers exerts pressure directly against the respective sleeves.

6. A combination as defined in claim 1, wherein said sealing elements are deformable and further comprising inserts recessed into said internal surfaces intermediate said sealing elements and the nearest end faces of the respective gears to prevent a deformed sealing element from contacting the respective gear.

7. A combination as defined in claim 1, wherein each of said sealing elements is a polygonal frame completely surrounding the respective plenum chamber.

8. A combination as defined in claim 1, wherein each bearing member has a flat and the flats of bearing members for the stubs of one of said gears abut against the flats of the bearing members for the stubs of the other of said gears.

9. A combination as defined in claim 1, wherein each of said grooves extends along an arc of approximately 180°, as considered in the circumferential direction of the respective stub and to both sides of the resultant of forces which the stub transmits to the respective bearing member.

10. A combination as defined in claim 9, each of said recesses extending along the same arc as the respective groove.

11. A combination as defined in claim 1, further comprising means for connecting each of said chambers with said one opening of said housing.

12. A combination as defined in claim 11, wherein said connecting means includes channels in said bearing members.

* * * * *